US005088294A

United States Patent [19]

Ando

[11] Patent Number: 5,088,294

[45] Date of Patent: Feb. 18, 1992

[54] CONDENSER WITH A BUILT-IN RECEIVER

[75] Inventor: Nobuyasu Ando, Takasaki, Japan

[73] Assignee: Sanden Corporation, Gunma, Japan

[21] Appl. No.: 473,831

[22] Filed: Feb. 2, 1990

[30] Foreign Application Priority Data

Feb. 3, 1989 [JP] Japan ..... 1-11466[U]

[51] Int. Cl.[5] ..... F25D 15/00

[52] U.S. Cl. ..... 62/119; 62/509; 165/110

[58] Field of Search ..... 62/509, 119; 165/110

[56] References Cited

U.S. PATENT DOCUMENTS

| | | | |
|---|---|---|---|
| 1,795,878 | 4/1928 | Mougey | 165/110 |
| 2,200,788 | 3/1939 | Coy | 165/110 |
| 2,612,349 | 9/1952 | Lintern | 165/96 |
| 3,063,682 | 11/1962 | Greene et al. | 165/110 |
| 4,825,941 | 5/1989 | Hoshino et al. | 165/110 |

FOREIGN PATENT DOCUMENTS

| | | |
|---|---|---|
| 63-112065 | 10/1986 | Japan . |
| 2-13953 | 1/1990 | Japan . |
| 160689 | 10/1957 | Sweden . |
| 143822 | 5/1920 | United Kingdom . |

*Primary Examiner*—Albert J. Makay
*Assistant Examiner*—John Sollecito
*Attorney, Agent, or Firm*—Banner, Birch, McKie & Beckett

[57] ABSTRACT

A condenser for a refrigerant circuit including a compressor, a condenser, an expansion valve and an evaporator which are sequentially disposed is disclosed. The condenser includes a plurality of tubes having opposite first and second open ends, and a plurality of fins disposed between the plurality of tubes. First and second header pipes are fixedly disposed at the opposite ends respectively, and the open ends of the tubes are disposed in fluid communication with the interior of the header pipes. The first header pipe has an inlet which links the condenser to an external element of the circuit. The second header pipe includes a wall partitioning an interior of the second header pipe into first and second isolated cavities which are linked by a pipe member. An outlet union joint is linked to the second cavity. In operation, the refrigerant condenses to a mist as it passes through the condenser into the first cavity. The misty refrigerant is formed into drops of liquid as it passes from the first cavity to the second cavity and in the second cavity. The liquid drops accumulate in the second cavity and are discharged through the outlet union joint. Since the condenser of the present invention includes a receiver in the second header pipe, the need for a separate receiver element in the circuit is eliminated.

36 Claims, 8 Drawing Sheets

CONDENSER WITH A BUILT-IN RECEIVER

BACKGROUND OF THE INVENTION

1. Technical Field

The present invention relates to a heat exchanger, and more particularly, to a heat exchanging condenser for use in an automotive air-conditioning system.

2. Description of the Prior Art

With reference to FIG. 1, a conventional refrigerant circuit for use, for example, in an automotive air-conditioning system is shown. Circuit 1 includes compressor 10, condenser 20, receiver or accumulator 30, expansion device 40, and evaporator 50 serially connected through pipe members 60 which link the outlet of one component with the inlet of a successive component. The outlet of evaporator 50 is linked to the inlet of compressor 10 through pipe member 60 so as to complete the circuit. The links of pipe members 60 to each component of circuit 1 are made such that the circuit is hermetically sealed.

In operation of circuit 1, refrigerant gas is drawn from the outlet of evaporator 50 and flows through the inlet of compressor 10, and is compressed and discharged to condenser 20. The compressed refrigerant gas in condenser 20 radiates heat to an external fluid flowing through condenser 20, for example, atmospheric air, and condenses to the liquid state. The liquid refrigerant flows to receiver 30 and is accumulated therein. The refrigerant in receiver 30 flows to expansion device 40, for example, a thermostatic expansion valve, where the pressure of the liquid refrigerant is reduced. The reduced pressure liquid refrigerant flows through evaporator 50, and is vaporized by absorbing heat from a fluid flowing through the evaporator, for example, atmospheric air. The gaseous refrigerant then flows from evaporator 50 back to the inlet of compressor 10 for further compression and recirculation through circuit 1.

With further reference to FIGS. 1*a*, and 2–5, a prior art embodiment of condenser 20 as disclosed in Japanese Patent Application Publication No. 63-112065 is shown. Condenser 20 includes a plurality of adjacent, essentially flat tubes 21 having an oval cross-section and open ends which allow refrigerant fluid to flow therethrough. A plurality of corrugated fin units 22 are disposed between adjacent tubes 21. Circular header pipes 23 and 24 are disposed perpendicularly to flat tubes 21 and may have, for example, a clad construction. Each header pipe 23 and 24 includes outer tube 26 which may be made from alluminum and inner tube 28 made of a metal material which is brazed to the inner surface of outer tube 26. Outer tube 26 has slots 27 disposed therethrough. Flat tubes 21 are fixedly connected to header pipes 23 and 24 and are disposed in slots 27 such that the open ends of flat tubes 21 communicate with the hollow interior of header pipes 23 and 24. Inner tube 28 includes portions 28*a* which define openings corresponding to slots 27. Portions 28*a* are brazed to the inner ends of flat tubes 21 and ensure that tubes 21 are hermetically sealed within header pipes 23 and 24 when inserted in slots 27.

Header pipe 23 has an open top end and a closed bottom end. The open top end is sealed by inlet union joint 23*a* which is fixedly and hermetically connected thereto. Inlet union joint 23*a* is linked to the outlet of compressor 10. Partition wall 23*b* is fixedly disposed within first header pipe 23 at a location about midway along its length and divides header pipe 23 into upper cavity 231 and lower cavity 232 which is isolated from upper cavity 231. Second header pipe 24 has a closed top end and an open bottom end. The open bottom end is sealed by outlet union joint 24*a* fixedly and hermetically connected thereto. Outlet union joint 24*a* is linked to the inlet of receiver 30. Partition wall 24*b* is fixedly disposed within second header pipe 24 at a location approximately one-third of the way along the length of second header pipe 24 and divides second header pipe 24 into upper cavity 241 and lower cavity 242 which is isolated from upper cavity 241. The location of partition wall 24*b* is lower than the location of partition wall 23*a*.

In operation, compressed refrigerant gas from compressor 10 flows into upper cavity 231 of first header pipe 23 through inlet union joint 23*a*, and is distributed such that a portion of the gas flows through each of flat tubes 21 which is disposed above the location of partition wall 23*b*, and into an upper portion of upper cavity 241. Thereafter, the refrigerant in the upper portion of cavity 241 flows downward into a lower portion of upper cavity 241, and is distributed such that a portion flows through each of the plurality of flat tubes 21 disposed below the location of partition wall 23*b* and above the location of partition wall 24*b*, and into an upper portion of lower cavity 232 of first header pipe 23. The refrigerant in an upper portion of lower cavity 232 flows downwardly into a lower portion, and is again distributed such that a portion flows through each of the plurality of flat tubes 21 disposed below the location of partition wall 24*b*, and into lower cavity 242 of second header pipe 24. As the refrigerant gas sequentially flows through flat tubes 21, heat from the refrigerant gas is exchanged with the atmospheric air flowing through corrugated fin units 22 in the direction of arrow W as shown in FIG. 5. Since the refrigerant gas radiates heat to the outside air, it condenses to the liquid state as it travels through tubes 21. The condensed liquid refrigerant in cavity 242 flows out therefrom through outlet union joint 24*a* and into receiver 30 and the further elements of the circuit as discussed above.

In the prior art refrigerant circuit 1 as shown in FIGS. 1–5, condenser 20 and receiver 30 are distinct elements which are separately disposed within the engine compartment of the automobile. Therefore, condenser 20 and receiver 30 occupy a large portion of the limited free space within the engine compartment of the automobile which is available for the refrigerant circuit. Furthermore, the provision of a separate receiver and condenser complicates the installation of the refrigerant circuit into the engine compartment.

SUMMARY OF THE INVENTION

The present invention is directed to a condenser for a refrigerant fluid circuit. The condenser includes a plurality of tubes having opposite first and second open ends, and a plurality of fin units disposed between the plurality of tubes. First and second header pipes are fixedly disposed at the opposite ends respectively, and the open ends of the tubes are disposed in fluid communication with the interior of the header pipes. The first header pipe has an inlet which links the condenser to an external element of the circuit. The second header pipe has an element partitioning an interior of the second header pipe into first and second cavities. The first cavity is in fluid communication with the tubes such that refrigerant is received within the first cavity via the tubes. A first pipe member fluidly links an outlet means to a bottom portion of the second cavity. A second pipe member penetrates through the partitioning element to conduct refrigerant from the first cavity to the second cavity.

In a further embodiment the second pipe member is L-shaped with the shorter portion connected to the second cavity and the longer portion extending along the exterior surface of the second header pipe.

In a further embodiment, the second pipe member is L-shaped with the longer portion disposed within the second cavity and the shorter portion extending perpendicularly to the second header pipe.

In a further embodiment, the second header pipe is formed of two semi-cylindrical shaped pipes that are secured to each other along a chordal portion.

In a further embodiment, the second header pipe is formed from a pair of pipes having a trapezoidal cross-section secured along parallel side portions.

In a further embodiment, the second header pipe is formed from a cylinderical pipe divided into two cavities by a plate.

In a further embodiment, the second header pipe is formed from a pair of pipes having rectangular cross-section secured together along parallel side portions.

In a still further embodiment, a purifying element for filtering and drying the refrigerant is disclosed.

The present invention provides the advantage of reducing the volume of limited space within the engine compartment which must be devoted to the refrigerant circuit since the condenser and receiver are combined into one element which occupies less space than the separate elements utilized in the prior art. Moreover, the provision of a single combined condenser and receiver eliminates an entire distinct element from the refrigerant circuit, simplifying the installation of the refrigerant circuit within the engine compartment of the automobile.

Further advantages, features, and other aspects of this invention will be understood from the detailed description of the preferred embodiments of this invention with reference to the drawings.

DETAILED DESCRIPTION OF THE PREFERRED EMBODIMENTS

Figure 1:
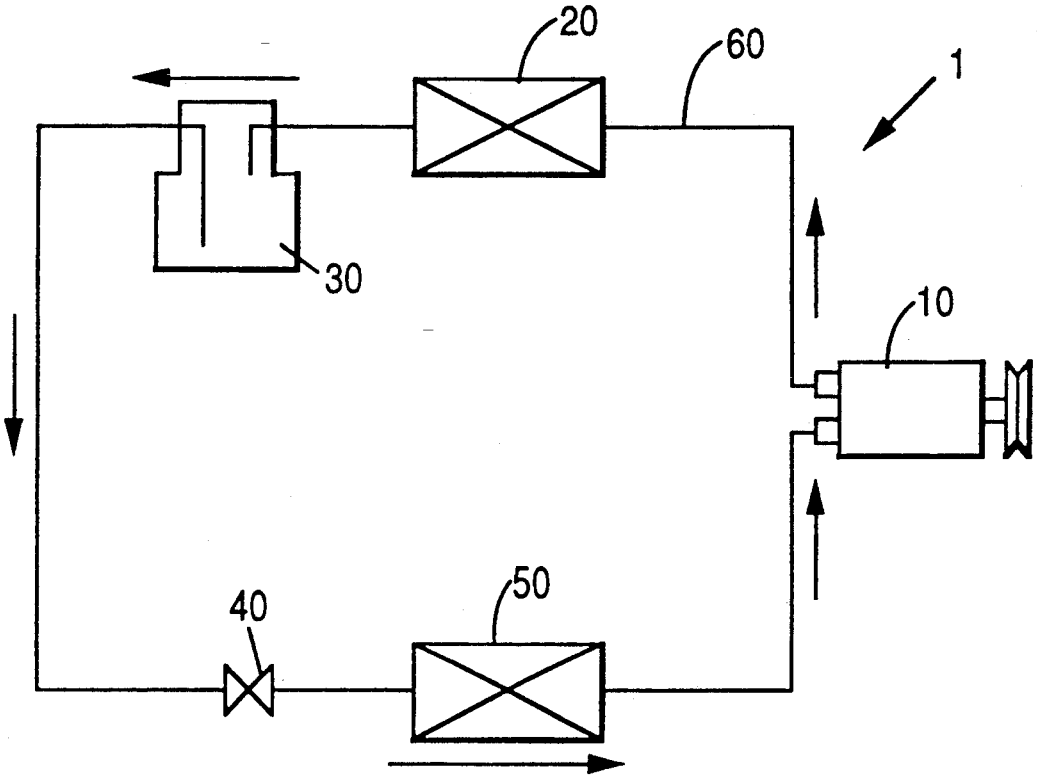
FIG. 1 PRIOR ART
FIG. 1 is a schematic block diagram of a refrigerant circuit in accordance with the prior art.
Figure 2:
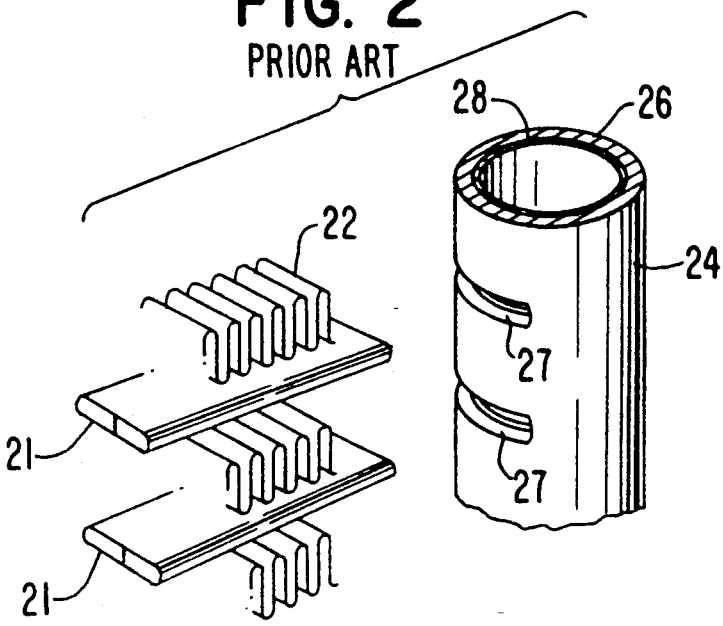
FIG. 2 PRIOR ART
FIG. 2 is a perspective view of certain elements of the condenser shown in FIG. 1*a*.
Figure 1A:
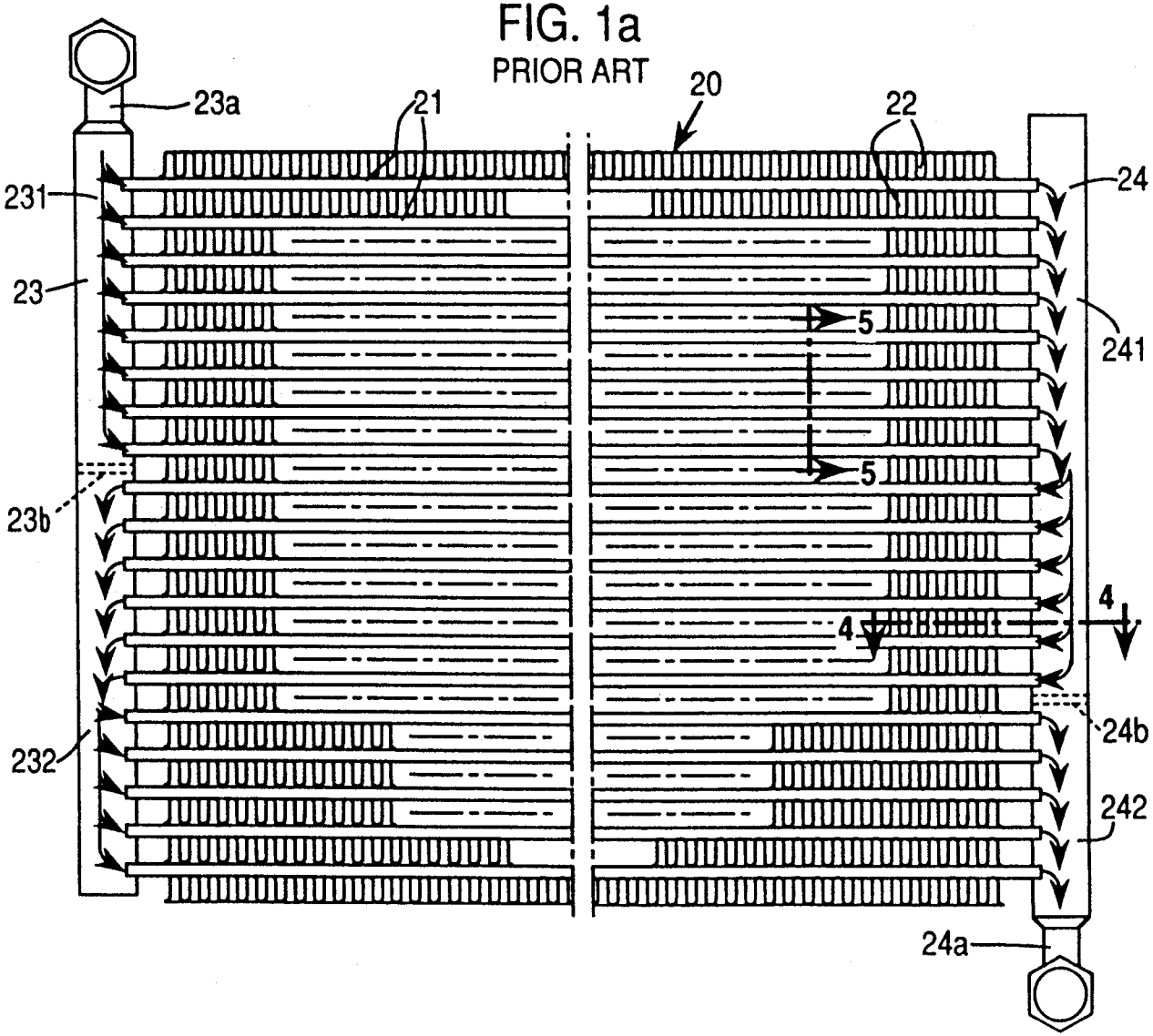
FIG. 1a PRIOR ART
FIG. 1*a* is an elevational view of the condenser shown in the refrigerant circuit of FIG. 1.
Figure 3:
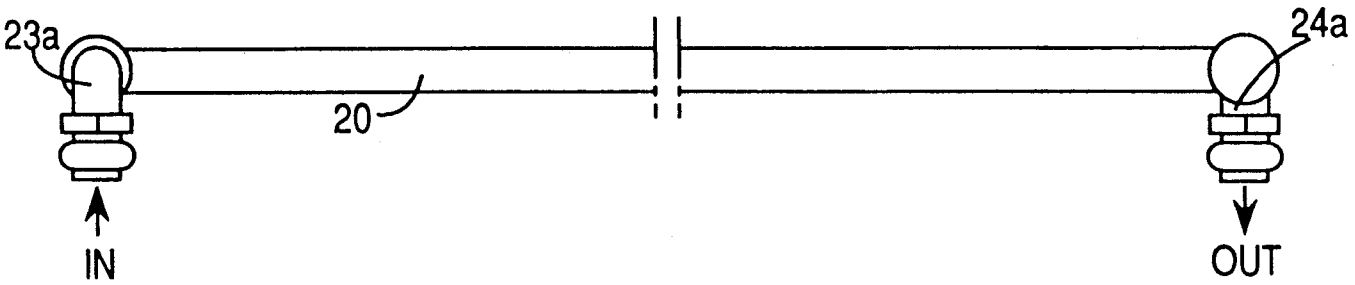
FIG. 3 PRIOR ART
FIG. 3 is a top view of the condenser shown in the prior art of FIG. 1*a*.
Figure 8:
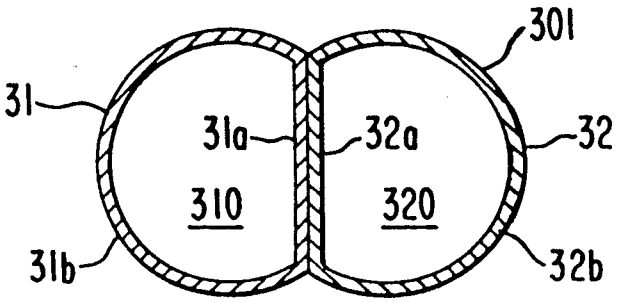
FIG. 8 is an enlarged fragmentary sectional view along line 8—8 shown in FIG. 6.
Figure 5:
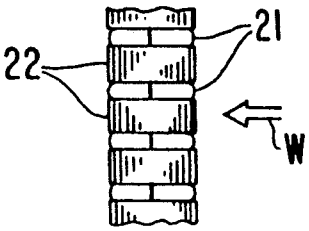
FIG. 5 PRIOR ART
FIG. 5 is a partial cross-section along line 5—5 in FIG. 1*a*.
Figure 4:
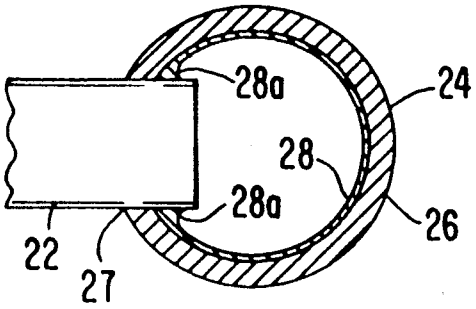
FIG. 4 PRIOR ART
FIG. 4 is a partial cross-section along line 4—4 in FIG. 1*a*.

With reference to FIGS. 6–9, the construction of a condenser in accordance with a first embodiment of the present invention is shown. In the figures, the same reference numerals are used to denote corresponding elements shown in the prior art figures. Therefore, a complete explanation of those elements is omitted. Condenser 200 includes first header pipe 230 having both ends closed, and second header pipe assembly 301 having both ends closed. A plurality of adjacent and parallel flat tubes 21 having open ends are disposed perpendicularly to first header pipe 230 and second header pipe assembly 301. The ends of tubes 21 are fixedly disposed in header pipe 230 as shown in FIG. 4 such that the openings of tubes 21 are in fluid communication with the hollow interiors of the header pipe. Corrugated fin units 22 are disposed between adjacent flat tubes 21. Tubes 21 and fin units 22 jointly form heat exchanging region 200*a*. Inlet union joint 230*a* is fixedly and hermetically connected near the top end of first header pipe 230 and extends perpendicularly therefrom. Although not shown in the Figures, first header pipe 230 and second header pipe assembly 301 would have an inner tube brazed to an outer tube as shown in FIGS. 2 and 4 such that the various components of condenser 200 are joined together by brazing.

Figure 6:
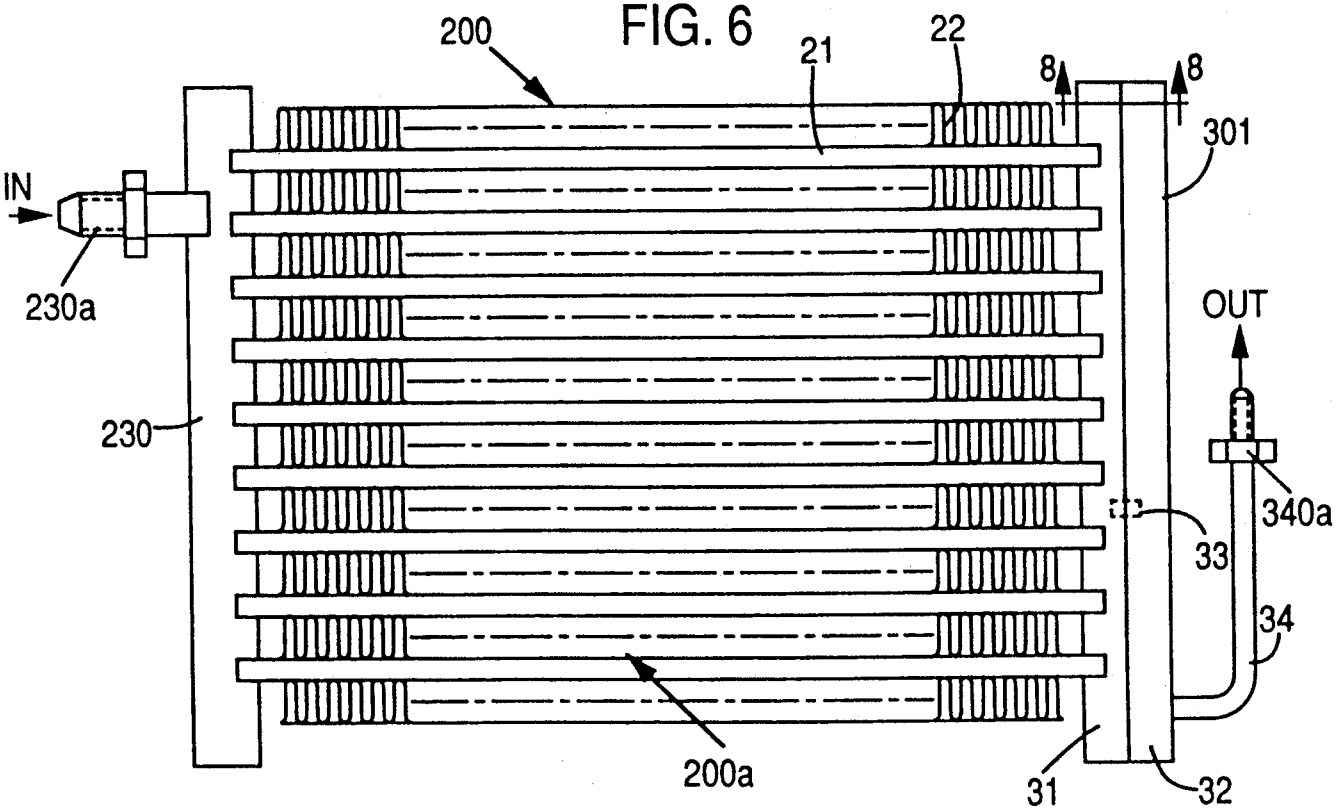
FIG. 6 is an elevational view of a condenser in accordance with a first embodiment of the present invention.
Figure 7:
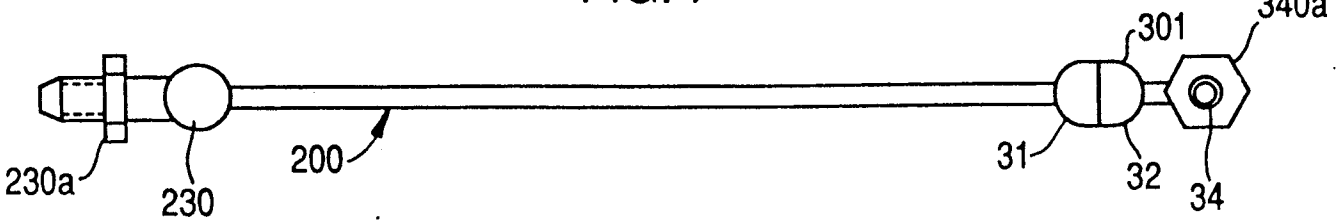
FIG. 7 is a top view of the condenser shown in FIG. 6.

Second header pipe assembly 301 comprises a pair of generally semi-cylindrical shaped pipes 31 and 32 having opposite closed ends, semi-circular portions 31*b* and 32*b*, and chordal or planar portions 31*a* and 32*a*, respectively, such as to define isolated cavities 310 and 320. Chordal portions 31*a* and 32*a* are fixedly secured together by brazing. Flat tubes 21 are fixedly and hermetically disposed in pipe 31 so as to be in fluid communication with cavity 310, in a manner similar to that described with respect to first header pipe 230. As can be seen in FIG. 6, the length of the vertical axis of second header pipe assembly 301 is substantially the same as the height of heat exchange region 200*a*.

Figure 9:
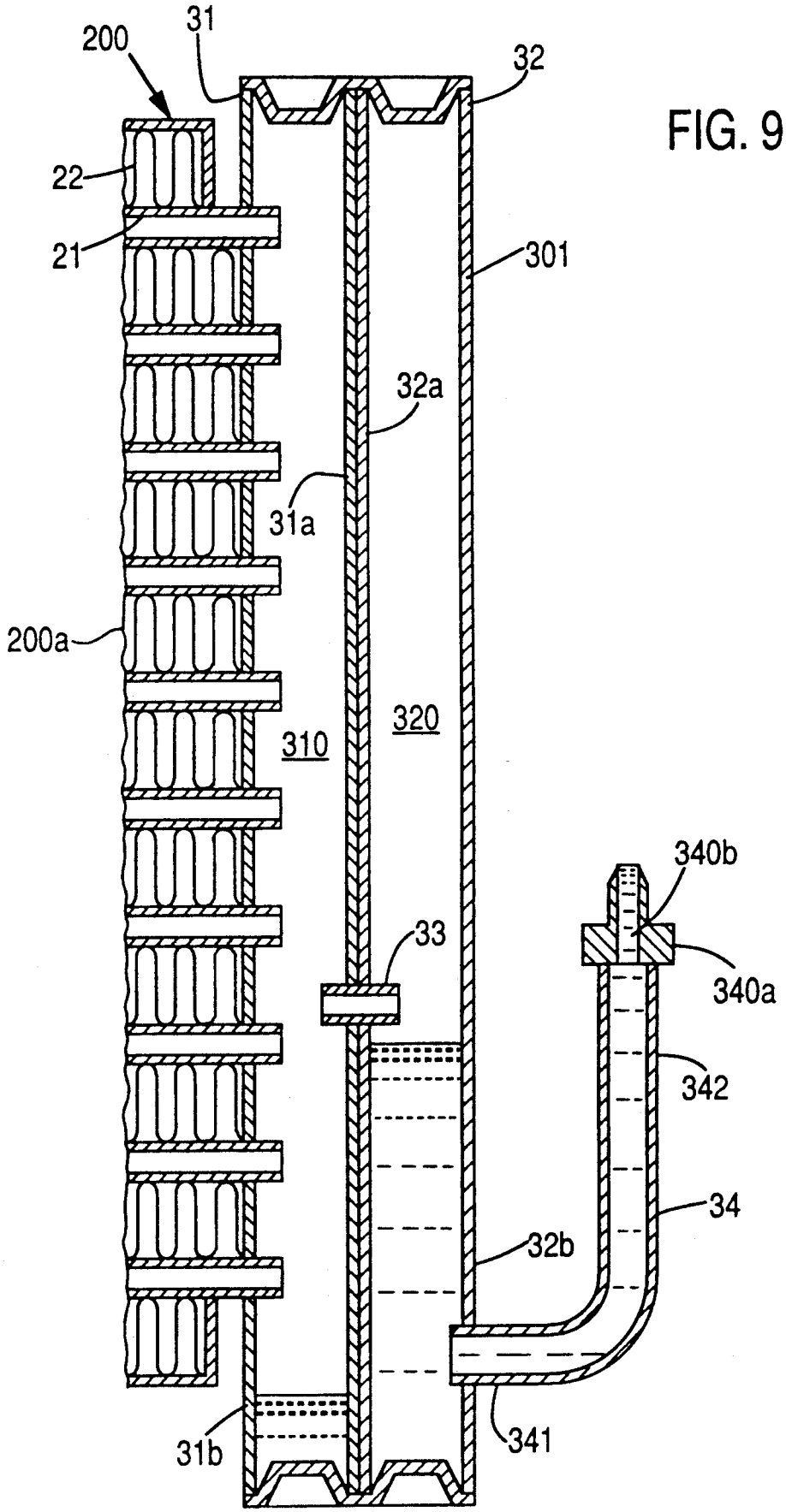
FIG. 9 is an enlarged fragmentary sectional view of the righthand side of FIG. 6.

With reference to FIG. 9, short pipe member 33 is disposed perpendicularly to the vertical axis of second header pipe assembly 301 at a location approximately one-third of the height from the bottom of second header pipe assembly 301. Pipe member 33 penetrates through chordal portions 31*a* and 32*a*, linking cavities 310 and 320 in fluid communication. Hollow L-shaped pipe member 34 includes short straight portion 341 and long straight portion 342 linked by a curved region. Short straight portion 341 is fixedly and hermetically secured in an opening through circular portion 32*b* at a location near the bottom thereof and is in fluid communication with cavity 320. Short straight portion 341 extends perpendicularly from second header pipe assembly 301, and long straight portion 342 is spaced from and extends parallel to circular portion 32*b*. Long straight portion 342 terminates at an open end at a location above the location of short pipe member 33. Outlet union joint 340*a* includes channel 340*b* therethrough and is secured to the open end of long straight portion 342. The elements as described above are all hermetically secured together by brazing.

In operation of condenser 200 of the present invention, compressed refrigerant gas from compressor 10 flows through inlet union joint 230*a* and into first header pipe 230, and is distributed such that a portion of the refrigerant gas flows through each of the plurality of flat tubes 21. The refrigerant gas within flat tubes 21 exchanges heat with the atmosphere and condenses to a state in which small particles of the refrigerant in the liquid state are suspended in gaseous refrigerant, that is, a refrigerant mist forms in semi-cylindrical shaped pipe 31. Most of the mist flows from pipe 31 through short pipe member 33 and into semi-cylindrical pipe 32. As the mist flows from pipe 31 to pipe 32, and also when the mist is present in pipe 32, the small particles of the mist collide with each other and are accumulated into larger drops of liquid refrigerant which collects at the bottom of pipe 32 due to the effect of gravity. The condensed refrigerant accumulates into a reservior at the bottom portion of pipe 32 because the terminal open end of L-shaped pipe member 34, at which outlet union joint 340*a* is positioned, is disposed at a location above the bottom of the semi-cylindrical pipe 32. Due to the operation of compressor 10, the condensed refrigerant accumulated within the bottom of pipe 32 flows upwardly through L-shaped pipe member 34, and sequentially through channel 340*b* of outlet union joint 340*a* and into expansion device 40 through pipe member 60. Additionally, the volume of the refrigerant which flows from pipe 32 to evaporator 50 may be controlled by varying the throttling effect of expansion device 40 in a known manner.

Since pipe 32 serves the purpose of receiver 30, the necessity for providing the refrigerant circuit with a separate condenser and a separate receiver is eliminated, and the overall size of the refrigerant circuit is reduced such that it takes up less free space within the engine compartment of the automobile. Additionally, the construction of the refrigerant circuit according to the present invention is simplified.

Figure 10:
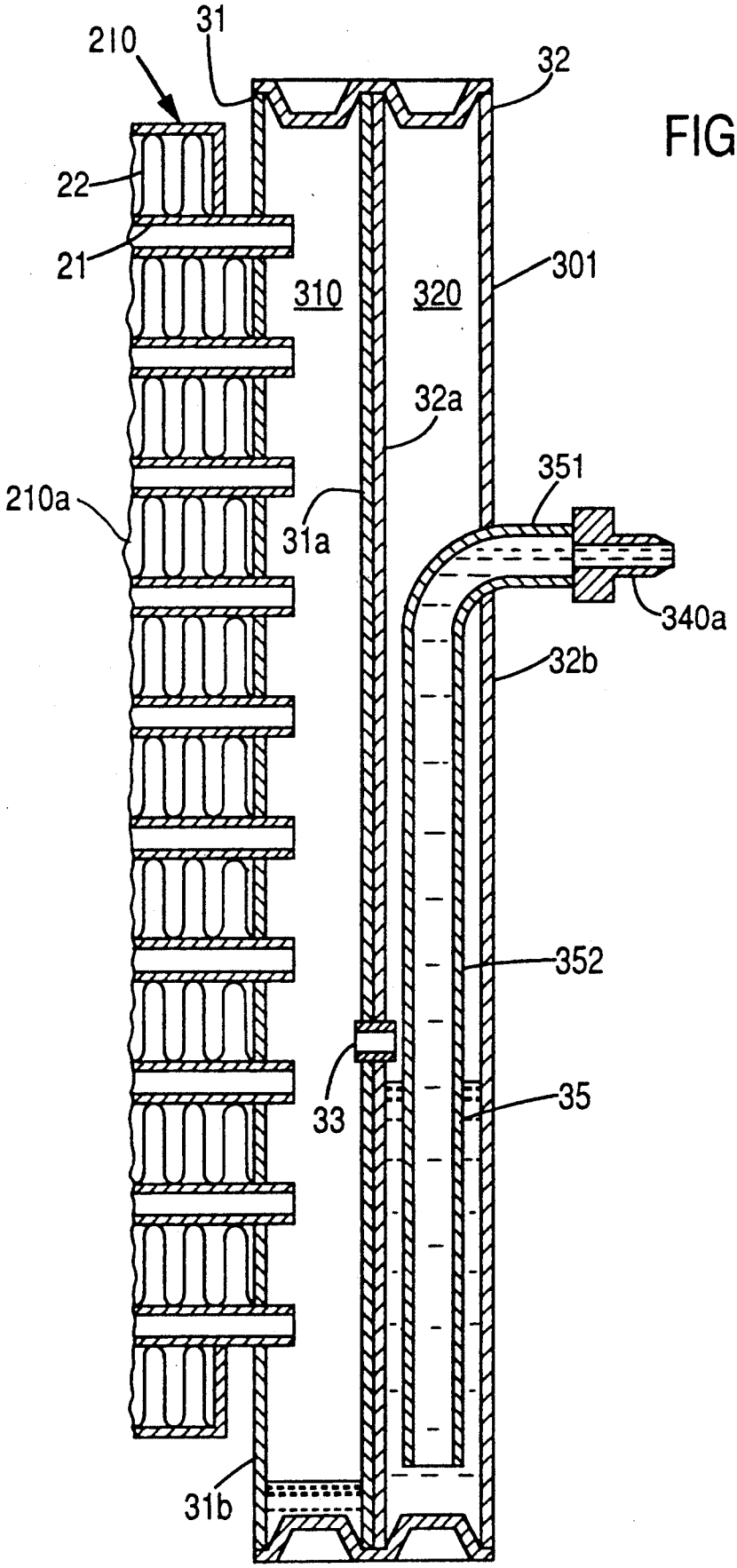
FIG. 10 is an enlarged fragmentary sectional view of a condenser in accordance with a second embodiment of the present invention.

With reference to FIG. 10, a second embodiment of the present invention is shown. In condenser 210 of the second embodiment, circular portion 32*b* of pipe 32 includes a hole formed therethrough at a location approximately two-thirds along the height of pipe 32. L-shaped pipe member 35 includes short straight portion 351 and long straight portion 352 linked by a curved region. Long straight portion 352 is disposed within pipe 32 along the vertical axis thereof and the open end of portion 352 terminates adjacent the closed bottom end of pipe 32. Short straight portion 351 of L-shaped pipe member 35 penetrates through the hole formed in circular-shaped portion 32*b* of pipe 32 and extends in a generally perpendicular direction relative to the vertical axis of pipe 32. The exterior surface of portion 351 is hermetically sealed within the hole in a manner similar to that shown with respect to tubes 21 and pipe 31. Outlet union joint 340*a* is secured to the open end of short straight portion 351. Although in the second embodiment outlet union joint 340*a* extends perpendicularly to header pipe assembly 301, since long portion 352 is disposed within pipe 32, outlet union joint 340*a* does not extend any further from assembly 301 than in the first embodiment. The condenser of the second embodiment functions similarly to the condenser of the first embodiment.

Figure 11:
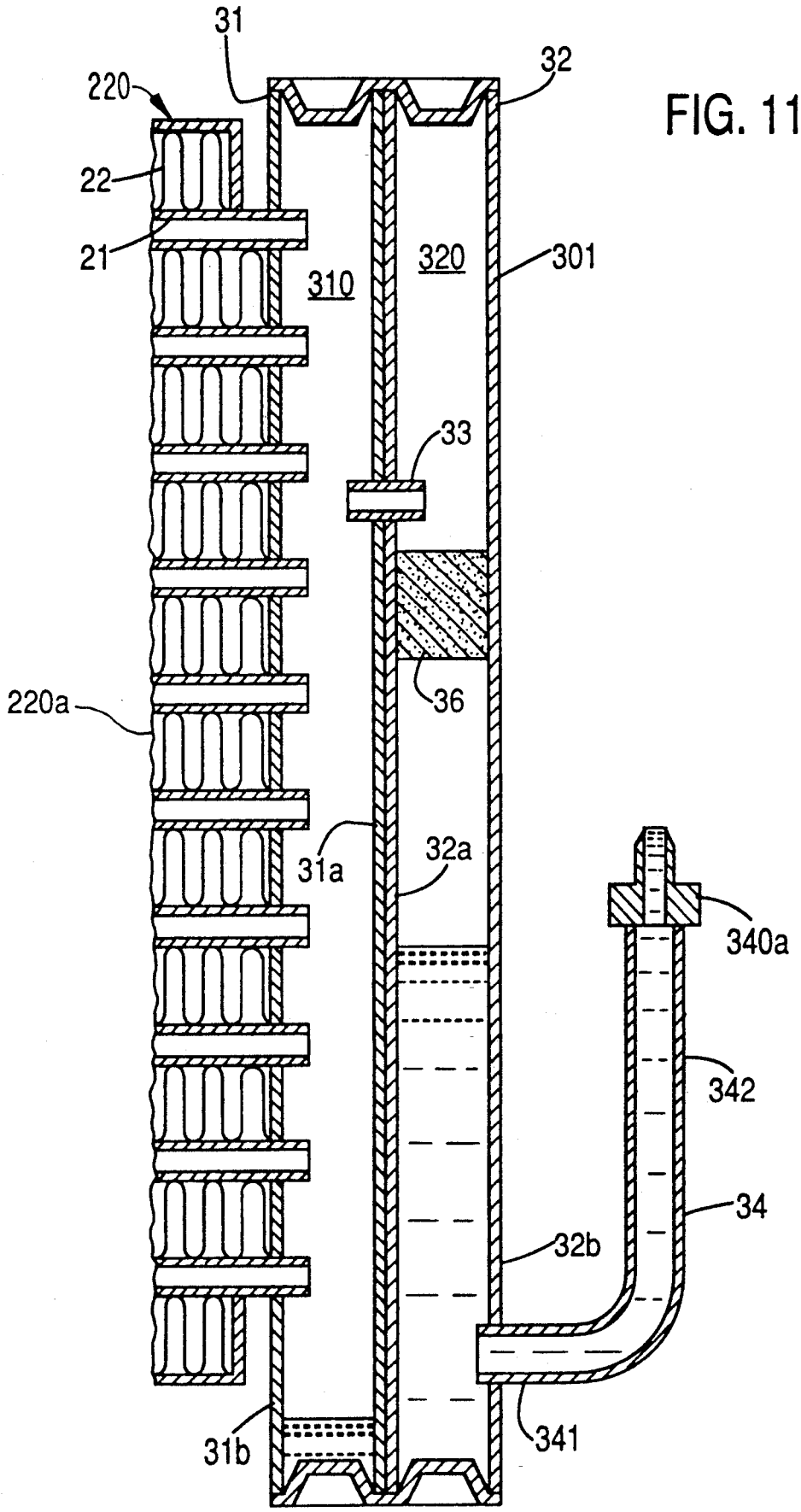
FIG. 11 is an enlarged fragmentary sectional view of a condenser in accordance with a third embodiment of the present invention.

With reference to FIG. 11, a condenser according to a third embodiment of the present invention is disclosed. In condenser 220 of this embodiment short pipe member 33 is disposed at a location above the location of outlet union joint 340*a*, for example, approximately two thirds along the height of second header pipe assembly 301. Pipe 32 includes purifying element 36 fixedly disposed in pipe 32 at a location between the location of short pipe member 33 and the location of outlet union joint 340*a* at the terminal end of long straight portion 342 of L-shaped pipe member 34. Purifying element 36 may function as a filter and/or a dryer for filtering and/or drying the refrigerant. Purifying element 36 is designed to last the life of the condenser, therefore replacement is not required.

Figure 12:
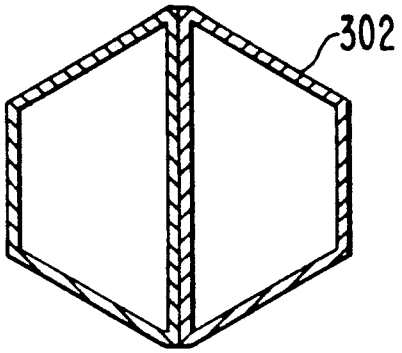
FIG. 12 is an enlarged fragmentary sectional view similar to FIG. 8 in accordance with a fourth embodiment of the present invention.
Figure 13:
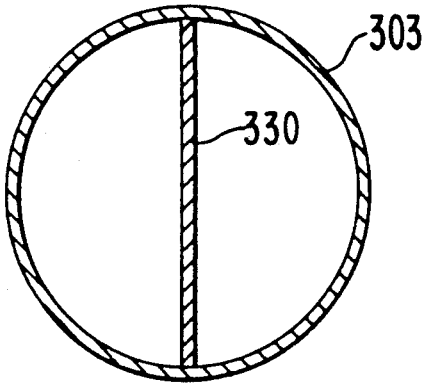
FIG. 13 is an enlarged fragmentary sectional view similar to FIG. 8 in accordance with a fifth embodiment of the invention.
Figure 14:
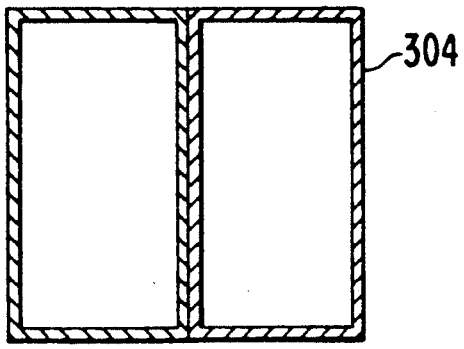
FIG. 14 is an enlarged fragmetary sectional view similar to FIG. 8 in accordance with a sixth embodiment of the invention.

FIGS. 12–14 illustrate three additional embodiments of the present invention. Instead of using semi-cylindrical pipes 31 and 32 as shown in FIGS. 8–11, various other cross-sectional shapes can be used. For example, pipes 31 and 32 may comprise trapezoids 302 as shown in FIG. 12. Alternatively, pipe assembly 303 may comprise a single cylindrical pipe having axial plate 330 disposed therein and dividing the pipe into half-cylinders as shown in FIG. 13. Pipe member 33 would be disposed in a hole formed through plate 330. Pipes 31 and 32 could also comprise rectangles 304 as shown in FIG. 14.

This invention has been described in detail in connection with the preferred embodiments. These embodiments, however, are merely for example only and the invention is not restricted thereto. It will be understood by those skilled in the art that other variations and modifications can easily be made within the scope of this invention as defined by the appended claims.

I claim:

1. In a condenser for a refrigerant fluid circuit, said condenser comprising a plurality of tubes having opposite first and second open ends, a plurality of fin units disposed between said plurality of tubes, first and second header pipe assemblies fixedly disposed at said opposite ends respectively, said open ends of said tubes disposed in fluid communication with the interior of said header pipe assemblies, said first header pipe assembly having an inlet means for linking the condenser to an external element of the circuit, said second header pipe assembly having an outlet means for linking the condenser to an external element of the circuit, the improvement comprising:

said second header pipe assembly including at least one partition means for partitioning an interior of said second header pipe assembly into first and second cavities, said first cavity in fluid communication with and receiving refrigerant from each of said tubes, and a conducting means for conducting refrigerant from said first cavity to said second cavity, said outlet means linked to said second cavity, said first and second cavities substantially isolated except for said conducting means.

2. The condenser recited in claim 1 further comprising a first pipe member linking said second cavity at a location near the bottom thereof to said outlet means.

3. The condenser recited in claim 2, said first pipe member being L-shaped and having a long side and a short side linked by a curved portion, both ends of said first pipe member being open.

4. The condenser recited in claim 3, said second header pipe assembly having a hole therethrough on the side of said second cavity at a location near the bottom thereof, said short side of said first pipe member disposed in said hole and said long side extending exterior of and upwardly along said second header pipe assembly, said outlet means disposed on said open end of said long side.

5. The condenser recited in claim 4, said conducting means comprising a second pipe member penetrating said partition means.

6. The condenser recited in claim 5, said outlet means disposed at a location along said second header pipe assembly which is higher than the location of said second pipe member.

7. The condenser recited in claim 5, said second pipe member disposed at a location of said second header pipe assembly which is higher than said outlet means.

8. The condenser recited in claim 7 further comprising means for purifying the refrigerant disposed within said second cavity at a location higher than the location of said outlet means and lower than the location of said second pipe member.

9. The condenser recited in claim 8, said means for purifying comprising a filter and a dryer.

10. The condenser recited in claim 3, said second header pipe assembly having a hole formed therethrough on the side of said second cavity, said long side of said L-shaped first pipe member disposed within said second cavity and said short side extending through said hole, said outlet means disposed on said open end of said short side.

11. The condenser recited in claim 10, said conducting means comprising a second pipe member penetrating said partition means.

12. The condenser recited in claim 11, said outlet means disposed at a location along said second header pipe assembly which is higher than the location of said second pipe member.

13. The condenser recited in claim 12, said second pipe member disposed approximately one third of the length from the bottom of said second header pipe assembly and said outlet means disposed approximately two thirds of the length from the bottom of said second header pipe assembly.

14. The condenser recited in claim 2, said conducting means comprising a second pipe member penetrating said partition means and linking said first and second cavities, said first cavity and said second cavity hermetically isolated except for said link.

15. The condenser recited in claim 14, said second header pipe assembly comprising a pair of pipes having a semi-cylindrical cross-section and fixedly secured to each other at chordal portions, each of said pair of pipes comprising one said cavity, said partition means comprising said chordal portions.

16. The condenser recited in claim 14, said second header pipe assembly comprising a pair of pipes having trapezoidal cross-section fixedly secured to each other along side portions that are disposed in parallel relationship, each of said pair of pipes comprising one said cavity, said partition means comprising said side portions.

17. The condenser recited in claim 14, said second header pipe assembly comprising a pipe having a cylindrical cross-section, said partition means comprising a plate dividing said cylindrical pipe into said two cavities.

18. The condenser recited in claim 14, said second header pipe assembly comprising a pair of pipes having rectangular cross-section fixedly secured to each other along side portions that are disposed in parallel relationship, each of said pair of pipes comprising one said cavity, said partition means comprising said side portions.

19. The condenser recited in claim 1, said conducting means comprising a pipe member penetrating said partition means and linking said first and second cavities, said first cavity and said second cavity hermetically isolated except for said link.

20. The condenser recited in claim 1 further comprising means for purifying the refrigerant.

21. The condenser recited in claim 20, said means for purifying disposed within said second cavity between said conducting means and said bottom portion of said cavity.

22. The condenser recited in claim 20, said means for purifying comprising a filter.

23. The condenser recited in claim 20, said means for purifying comprising a dryer.

24. The condenser recited in claim 20, said means for purifying comprising a filter and a dryer.

25. The condenser recited in claim 1, said second header pipe assembly comprising at least one pipe having a cross-section selected from one of the following: cylindrical, semi-cylindrical, rectangular or trapezoidal.

26. The condenser recited in claim 1, said second header pipe assembly comprising a pair of pipes having a semi-cylindrical cross-section and fixedly secured to each other at chordal portions, each of said pair of pipes comprising one said cavity, said partition means comprising said chordal portions.

27. The condenser recited in claim 1, said second header pipe assembly comprising a pair of pipes having trapezoidal cross-section fixedly secured to each other along side portions that are disposed in parallel relationship, each of said pair of pipes comprising one said cavity, said partition means comprising said side portions.

28. The condenser recited in claim 1, said second header pipe assembly comprising a pipe having a cylindrical cross-section, said partition means comprising a plate dividing said cylindrical pipe into said two cavities.

29. The condenser recited in claim 1, said second header pipe assembly comprising a pair of pipes having rectangular cross-section fixedly secured to each other along side portions that are disposed in parallel relationship, each of said pair of pipes comprising one said cavity, said partition means comprising said side portions.

30. In a refrigerant circuit comprising a compressor, a condenser, an expansion element and an evaporator sequentially disposed, said condenser comprising a plurality of tubes having opposite first and second open ends, a plurality of fin units disposed between said plurality of tubes, first and second header pipes fixedly disposed at said opposite ends respectively, said open ends of said tubes disposed in fluid communication with the interior of said header pipes, said first header pipe having an inlet means for linking the condenser to said compressor, said second header pipe having an outlet means for linking the condenser to said expansion element, the improvement wherein:

said second header pipe further including at least one partition means for partitioning an interior of said second header pipe into first and second cavities, said first cavity in fluid communication with and receiving refrigerant from each of said flat tubes, and a conducting means for conducting refrigerant from said first cavity to said second cavity, said first and second cavity hermetically isolated except for said conducting means, said outlet means linked to said second cavity.

31. In a condenser for a refrigerant fluid circuit, said condenser comprising a plurality of tubes having opposite first and second open ends, a plurality of fin units disposed between said plurality of tubes, first and second header pipe assemblies fixedly disposed at said opposite ends respectively, said open ends of said tubes disposed in fluid communication with the interior of said header pipe assemblies, said first header pipe assembly having an inlet means for linking the condenser to an external element of the circuit, said second header pipe assembly having an outlet means for linking the condenser to an external element of the circuit, the improvement comprising:

said second header pipe assembly including at least one partition means for partitioning an interior of said second header pipe assembly into first and second cavities, said first cavity in fluid communication with and receiving refrigerant from each of said tubes, a conducting means for conducting refrigerant from said first cavity to said second cavity, and a pipe member linking said second cavity at a location near the bottom thereof to said outlet means.

32. In a condenser for a refrigerant fluid circuit, said condenser comprising a plurality of tubes having opposite first and second open ends, a plurality of fin units disposed between said plurality of tubes, first and second header pipe assemblies fixedly disposed at said opposite ends respectively, said open ends of said tubes disposed in fluid communication with the interior of said header pipe assemblies, said first header pipe assembly having an inlet means for linking the condenser to an external element of the circuit, said second header pipe assembly having an outlet means for linking the condenser to an external element of the circuit, the improvement comprising:

said second header pipe assembly including at least one partition means for partitioning an interior of said second header pipe assembly into first and second cavities, said first cavity in fluid communication with and receiving refrigerant from each of said tubes, a conducting means for conducting refrigerant from said first cavity to said second cavity, and an L-shaped pipe member having a long side and a short side linked by a curved portion, both ends of said pipe member being open, said first pipe member linking said second cavity to said outlet means.

33. In a condenser for a refrigerant fluid circuit, said condenser comprising a plurality of tubes having opposite first and second open ends, a plurality of fin units disposed between said plurality of tubes, first and second header pipe assemblies fixedly disposed at said opposite ends respectively, said open ends of said tubes disposed in fluid communication with the interior of said header pipe assemblies, said first header pipe assembly having an inlet means for linking the condenser to an external element of the circuit, said second header pipe assembly having an outlet means for linking the condenser to an external element of the circuit, the improvement comprising:

said second header pipe assembly including at least one partition means for partitioning an interior of said second header pipe assembly into first and second cavities, said first cavity in fluid communication with and receiving refrigerant from each of said tubes, and a conducting means for conducting refrigerant from said first cavity to said second cavity, said outlet means linked to said second cavity, said condenser further comprising means for purifying the refrigerant.

34. In a condenser for a refrigerant fluid circuit, said condenser comprising a plurality of tubes having opposite first and second open ends, a plurality of fin units disposed between said plurality of tubes, first and second header pipe assemblies fixedly disposed at said opposite ends respectively, said open ends of said tubes disposed in fluid communication with the interior of said header pipe assemblies, said first header pipe assembly having an inlet means for linking the condenser to an external element of the circuit, and said second header pipe assembly having an outlet means for linking the condenser to an external element of the circuit, a method for accumulating condensed refrigerant in the condenser, said method comprising the steps of:

partitioning the second header pipe into first and second cavities with a fluid conducting element linking the first and second cavities;

causing refrigerant to flow through the tubes in a direction from the first header pipe assembly to the second header pipe assembly and condense into a mist, the mist forming in the first cavity, the mist including small particles of liquid refrigerant; and causing the mist to flow from the first cavity to the second cavity through the conducting element, the flow of the mist through the conducting element causing the small particles of liquid refrigerant to accumulate into larger drops, the larger drops collecting in the second cavity.

35. In a condenser for a refrigerant fluid circuit, said condenser comprising a plurality of tubes having opposite first and second open ends, a plurality of fin units disposed between said plurality of tubes, first and second header pipe assemblies fixedly disposed at said opposite ends respectively, said open ends of said tubes disposed in fluid communication with the interior of said header pipe assemblies, said first header pipe assembly having an inlet means for linking the condenser to an external element of the circuit, said second header pipe assembly having an outlet means for linking the condenser to an external element of the circuit, the improvement comprising:

said second header pipe assembly including at least one partition means for partitioning an interior of said second header pipe assembly into first and second cavities, said first cavity in fluid communication with and receiving refrigerant from each of said tubes, and a conducting means for conducting refrigerant from said first cavity to said second cavity and for causing refrigerant mist present in said first cavity to accumulate into larger drops of liquid, said outlet means linked to said second cavity, said first and second cavities substantially isolated except for said conducting means.

36. In a condenser for a refrigerant fluid circuit, said condenser comprising a plurality of tubes having opposite first and second open ends, a plurality of fin units disposed between said plurality of tubes, first and second header pipe assemblies fixedly disposed at said opposite ends respectively, said open ends of said tubes disposed in fluid communication with the interior of said header pipe assemblies, said first header pipe assembly having an inlet means for linking the condenser to an external element of the circuit, said second header pipe assembly having an outlet means for linking the condenser to an external element of the circuit, the improvement comprising:

said second header pipe assembly including at least one partition means for partitioning an interior of said second header pipe assembly into first and second cavities, said first cavity in fluid communication with and receiving refrigerant from each of said tubes, and a conducting means for conducting refrigerant from said first cavity to said second cavity, said conducting means positioned below the uppermost of said tubes, said outlet means linked to said second cavity, said first and second cavities substantially isolated except for said conducting means.

* * * * *